United States Patent [19]

Likins

[11] 4,323,748

[45] Apr. 6, 1982

[54] POWER TRANSFER SYSTEM

[75] Inventor: Robert W. Likins, Hoffman Estates, Ill.

[73] Assignee: American Can Company, Greenwich, Conn.

[21] Appl. No.: 139,427

[22] Filed: Apr. 11, 1980

[51] Int. Cl.[3] ..... H05B 6/04; H01R 39/26

[52] U.S. Cl. ..... 219/10.71; 219/10.75; 219/10.79; 339/5 M; 339/8 R; 361/8; 310/222; 307/135

[58] Field of Search ..... 219/10.71, 10.69, 10.67, 219/10.75, 10.77, 10.79, 10.57; 339/5 R, 5 A, 5 L, 5 M, 5 P, 5 RL, 5 S, 8 R, 8 A, 8 L, 8 P, 8 PB, 8 PS, 8 PL, 6 R, 6 A, 6 RL; 310/220, 221, 222; 361/2, 3, 8; 307/135, 137

[56] References Cited

U.S. PATENT DOCUMENTS

| | | | |
|---|---|---|---|
| 894,329 | 7/1908 | Kennedy | 310/220 X |
| 2,541,527 | 2/1951 | Martin | 339/5 S |
| 3,268,218 | 8/1966 | Eannarino | 219/10.69 X |
| 3,431,382 | 3/1969 | Esche et al. | 219/10.75 X |
| 4,246,461 | 1/1981 | Jeppson | 219/10.71 X |

*Primary Examiner*—B. A. Reynolds

*Assistant Examiner*—Philip H. Leung

*Attorney, Agent, or Firm*—Robert P. Auber; George P. Ziehmer; Stuart S. Bowie

[57] ABSTRACT

Disclosed is a method of transferring energy from a stationary generator of power at radio frequencies to a rotating work station such as a coil to heat inductively by selectively connecting the generator as the work station rotates past the generator. A pair of stationary contact strips connected to the generator are used to connect the low voltage, high current radio frequency (RF) energy to the rotating machine. The contact strips are a commutating device in that they can intermittently be connected to a series of brushes or contactors carried by work stations requiring power. The contact strips form a closed loop which shunts the energy at the point where the brushes engage and/or leave the contact strips thereby keeping the current flow to a minimum at those points. As the brushes slide across the contact strips they move from the shunt to the power input points on the contact strips and where the current flow increases because the voltage difference between the strips is the greatest. Consequently, the power can be transferred to the work stations without arcing as the brushes engage or leave the contact strips.

20 Claims, 3 Drawing Figures

POWER TRANSFER SYSTEM

BACKGROUND OF THE INVENTION

This invention relates to a rotary work table, turret of wheel carrying RF heating coils which are located at a series of stations about the periphery of the rotating work carrier. Each RF heater has to be supplied with power at a prescribed time during the rotation of work carrier whereby work will be performed in a curing, baking, sealing, processing, heating or a similar operation. This necessitates a commutation device for carrying RF energy at low voltage high current and frequencies in the radio wave range (450 kHz). In the past such commutation was accomplished by switching devices which include a large set of bus bars, slip rings or commutating bars that were mounted on the rotating member and caused to pass stationary contacts carried by a RF power supply. The problem with such arrangements was the tendency to arc at the point where contact or switching occurred. The transfer of high current on an intermittent basis caused care and safety problems with respect to the operation of such machinery. Another approach was to carry the power source with the rotary member, but this too was unacceptable because such power supplies are large in size and require numerous connection which complicate that approach.

SUMMARY OF THE INVENTION

In order to build a compact, reliable and simple arrangement for transferring RF energy from a fixed power supply to a rotating member and overcome the problems of the prior approaches, a shunted power supply loop was conceived and connected to a stationary RF power supply. The loop consists of a pair of contact strips which are connected to the power supply and held in parallel spaced relation. The middle of each strip receives the power while the end of each is shunted to the other. The loop is designed to follow the shape of the circumference of the rotating work carrying member whereby contact brushes can periodically engage or disengage the loop without arcing. The power received by the brushes is proportional to the distance on the loop i.e., from the loop shunt. That is to say that, the power available at the shunt portions of the loop is not transmitted since there is no potential difference between the contact strips which form that portion of the loop. More particularly, the contact strip connected to one power supply terminal and the contact strip connected to the other supply terminal have no potential difference at the shunts. As the contact brushes first engage the loop moving from the shunt to the point of the power connections the potential difference increases in accordance with the distance traversed. Consequently, the load attached to the brushes receives the power in an ever increasing fashion from the contact strips such that there is no sudden connection to the high power supply, which would cause contact arcing thus shortening brush and contact strip life or sparks. The load only receives varying potential difference which increases as the brushes move from the shunted portion of the loop where contact is first made to the center of the loop where the power connections enter the loop. Similarly, the power diminishes as the brushes continue across the loop from the power connections to the terminating shunt. At the shunts the potential difference across the contact strips is zero.

The foregoing system for transferring power from a stationary RF power supply to a rotating member can be accomplished overcoming the problems of the prior techniques.

OBJECTS OF THE INVENTION

It is an object of this invention to provide a low cost power transfer device for connecting RF energy from a stationary power supply to a moving set of contact brushes.

It is a further object of this invention to provide a power supply transfer means which is reliable, safe and simple to construct.

It is still a further object of this invention to provide a transfer loop having central power supply inputs connected to elongated legs of the loop which extend in both directions therefrom and are shunted at their ends thus forming a varying potential difference of the voltage in the legs of the loop which is a function of the distance from the power connections or the proximity of either shunt.

DETAILED DESCRIPTION OF THE DRAWINGS

Figure 1:
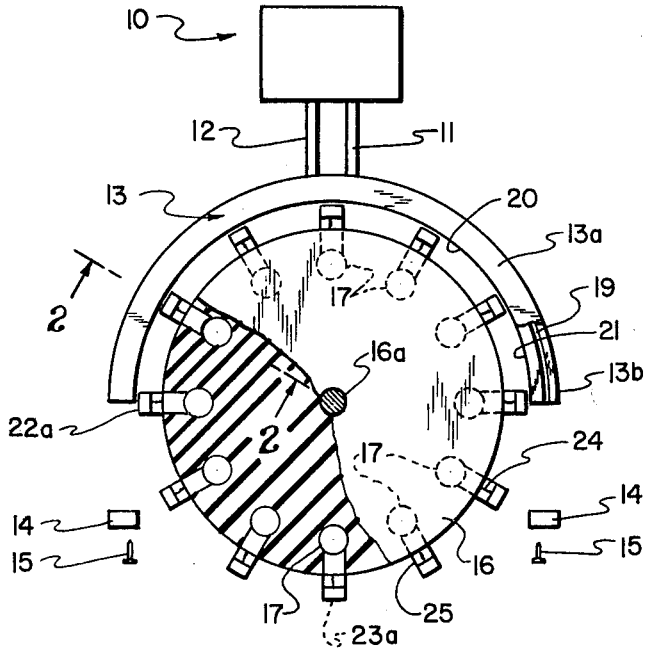
FIG. 1 is a perspective view showing the preferred embodiment of a power supply and an associated loop with shunted ends.

In FIG. 1 a power supply such as an induction heating generator 10 and output transformer is shown for providing RF energy at low voltage (200 to 1000 open circuit voltage), at high frequency (300 to 600 kHz) and at high current (75 to 200 amps). The generator 10 transmits power along a pair of upper and lower supply bus connections 11 and 12 to the loop generally designated 13 and being comprised of two semi-circular loop busses 13*a* (upper) and 13*b* (lower), FIG. 1. The loop busses 13*a* and 13*b* are disposed in parallel spaced relation to one another. The busses 11 or 12 and the loop 13 is fashioned from a suitable conductor such as copper and may be hollow whereby coolant can be circulated therethrough in order to maintain the operating temperature at a reasonable level notwithstanding the fact that high currents are being transmitted. At the ends of the respective loop busses 13*a* and 13*b* are shorting plates 14 which act to provide a shunted path for the ends of each loop. The shorting plates 14 are also made of suitable metal conductors such as copper and can include cooling passages. However, the plates 14 shown in FIG. 1 are not so equipt and are merely affixed by bolts 15 which are designed to hold the shorting plates 14 to the ends of the loop busses 13*a* and 13*b* in intimmate contact engagement.

The busses 13*a* and *b* are shown as spaced apart semicircular rings juxtaposed to each other and are connected to the bus connectors 11 and 12 at the center of their semi-circular form; the shorting plates 14 are located at the ends of the busses. It is that arrangement which varies the potential difference between the loop busses 13*a* and 13*b* depending upon position along the busses from the center to the ends where the shorting plates 14 are connected. The maximum potential difference is at the center where the supply busses 11 and 12 join the loop busses 13*a* and *b*.

In FIG. 1, the surfaces that face inwardly toward the center of the semi-circular arc are surfaces used for contacting the rotary brushes carried by a work table 16. The work table 16 has a central axis 16*a* about which it rotates and table 16 carries a number of induction heating coils 17 each of which are identical in design and are mounted to move with the table 16. The heating coils 17 and their contact brushes will be described in detail later in this specification. Suffice it to say for the present that, as they rotate along with table 16 and they engage with the loop busses 13*a* and 13*b* so that power is provided by each loop bus to a side of each coil 17.

Figure 3:
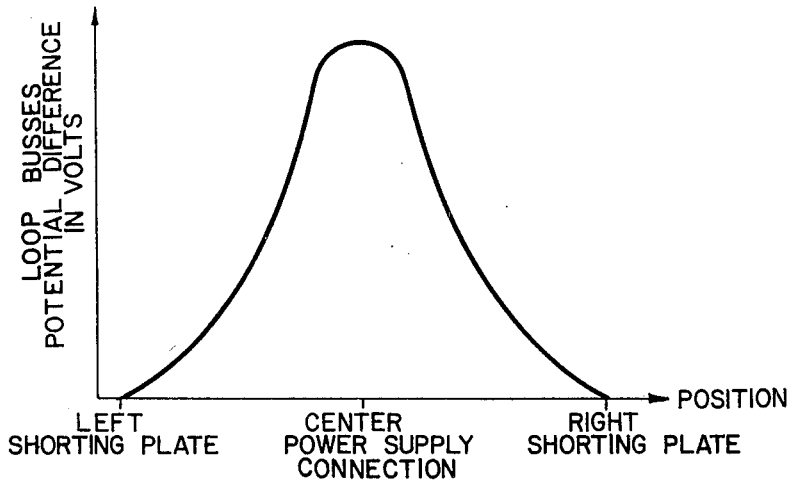
FIG. 3 is a voltage versus position graph depicting the varying potential difference between the legs of the loop in FIG. 1 at various locations from end to end along the loop.

FIG. 3 shows a voltage versus position graph having the variation of potential difference along the loop busses (on the verticle axis) and the distance or position along the loop bus from the left side shorting plate to the right side shorting plate (on the horizontal axis). As is apparent from FIG. 3, the potential difference of the voltage measured between the loop busses 13*a* and *b*, increases as location becomes closes to the center power supply connections, increasing to a maximum at the point of connection and conversely the potential difference diminishes between the loop busses 13*a* and *b* as the location is nearer to the shorting plates 14. It can be appreciated that the power available to a work coil 17 as it connects with the loop busses 13*a* and *b* near a shorting plate 14 will not be transferred with arcing because the potential difference at the shorting plate 14 is zero. Consequently, the contact brushes of the work coil 17 as they engage or disengage the loop busses 13*a* and *b* will not arc because the power transferred to the work coil at that point is zero and increases as a function of the distance traversed along the loop busses 13*a* and *b* toward the contact supply busses 11 and 12 in accordance with the graph of FIG. 3.

Figure 2:
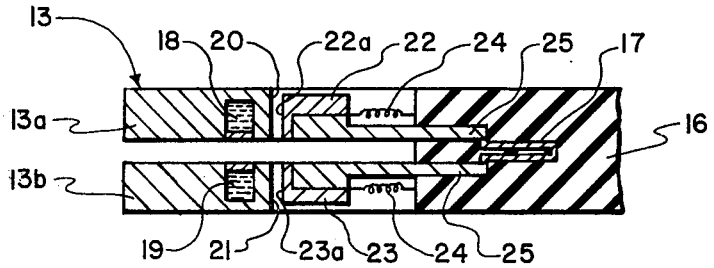
FIG. 2 is an enlarged cross-sectional view shown partially schematic for a contact brush arrangement to be used in connection with the loop and the cross-section is taken along section 2—2 through the loop in FIG. 1.

FIG. 2 is a cross-sectional view of a contact brush arrangement for work coil 17. More particularly, the loop busses 13*a* and *b* include passages for a cooling fluid labelled 18 and 19 respectively and such passages 18 and 19 commonly carry water. The cross-section of the loop bus 13 is generally rectangular, but any suitable shape which is convenient to manufacture can be used, for example, these busses could be manufactured out of any conventional tubing and those skilled in the art would appreciate that the contact brushes would be shaped to fit with complimentary surface on the bus. The smaller inwardly disposed face of the rectangular loop bus cross-section is designated 20 and 21 for the loop bus 13*a* and 13*b* respectively. These faces 20 and 21 form are inwardly with respect to the semi-circle formed by the loop bus 13 and are generally vertical surfaces (see FIG. 1). It is these faces 20 and 21 which are used to supply the power to the work coil 17. In FIG. 2, the work coil 17 is shown connected to a pair of movable contact brushes 22 and 23 designed to ride against surfaces 20 and 21 respectively. Each brush 22 or 23 has a contact face 22*a* or 23*a* which is shaped and positioned to bear against surfaces 20 or 21 respectively. The brushes are mounted for movement and are biased toward surfaces 20 and 21 and as shown schematically in FIG. 2. Non-metallic springs 24 are positioned between the work table 16 and the contact brushes 22 and 23. Each contact brush is carried by a suitable support and connector bus 25 which permits the contact brush 22 or 23 to slide therein toward the faces 20 or 21 respectively of the loop busses 13*a* or 13*b* due to the urging of its spring 24. The connector busses 25 are each connected to a leg of a work coil 17.

Thus, power is transmitted from loop bus 13*a* through surface 20 to the brush 22 via surface 22*a*, then to the connector bus 25 which carries it to one side of work coil 17 and therethrough to the other side of work coil 17 across the other connector bus 25 through brush 23 and its contact face 23*a* which engages with surface 21 of the loop bus 13*b* for applying a working load to the generator 10. The table 16 rotates and a series of work coils 17 are consecutively brought into engagement with the loop bus 13 one right after the other, and the power transmitted to each work coil 17 builds in accordance with the motion of the table 16 as it rotates about its pivot 16*a*. Thus, as the coils 17 approach the connecting supply bus 11 and 12 the power transmitted to each work coil 17 increases to a maximum and as the work table 16 moves that particular work coil 17 past the center of the loop bus 13. The power transmitted will begin to diminish and the coil 17 will continue to move toward the end of the loop bus which is away from the center.

Those skilled in the art will appreciate that the concept is broader than the particular loop configuration shown. More particularly, the invention in its broadest application is an appreciation of the fact that the potential differences between the contact strips of a commutating device can be varied from a minimum to a maximum whereby contact between the moving contact brushes and the fixed contact strips can be made at the site of the minimum voltage potential difference thus permitting connection without arcing. Similarly, the disconnection can be made at a site where potential difference is at a minimum. Applications with linear arrangements or even one-half of a loop are also to be covered in the claims which follow as well as different cross-sectional configurations for the contact strips, shunts and contact brushes. It is, therefore, desired that the claims which follow cover the entire spectrum of physical arrangements and motions between the the respective parts which could be used to take advantage of the disclosed invention.

What is claimed is:

1. An apparatus comprising:

a first and second means operatively associated with one another for movement of at least one said means relative to the other from a position away from one another to a position in contact, each of said means having a separated pair of surfaces positioned for rubbing engagement with each other when said means are in said contact position and one of said means having its said pair of surfaces elongated in the direction of said rubbing engagement, a power supply connected across said elongated pair of surfaces for activation to a state of electrical potential therebetween and the other of said pair of surfaces being electrically connected in circuit with a load adapted to intermittently receive said potential, said means with said pair of surfaces elongated being shunted at portions spaced apart from said power supply connection, and said first and second means are arranged when moving from said away from position to said contact position to first cross one of said shunted portions and then said power supply connections and finally the other of said shunted portions.

2. The apparatus of claim 1 wherein said means having elongated surfaces is connected to said power supply at one location which is most equidistant from said shunted portions.

3. The apparatus of claim 1 wherein said power supply connection location is disposed centrally between a pair of said shunted portions each being located most distant therefrom.

4. The apparatus of claim 1 wherein said means having elongated surfaces is connected to said load at one location which is most distant from said shunted portions.

5. The apparatus of claim 1 wherein said load connection location is disposed centrally between a pair of said shunted portions each being located most distant therefrom.

6. The apparatus of claim 1 wherein said one pair of surfaces are associated with said first means and said power supply is stationary and said other pair of surface are associated with said second means.

7. The apparatus of claim 6 wherein said power supply provides energy of low open circuit voltage, high amperage and high frequencies in a radio range.

8. The apparatus of claim 6 wherein said elongated pair of surfaces are connected to said power supply.

9. The apparatus of claim 7 wherein said first and second means are copper conductors having internal passages for coolant.

10. The apparatus of claim 6 wherein said load is a plurality of inductance coils and are carried on a rotating member for intermittent connection across said elongated pair of surfaces.

11. The apparatus of claim 10 wherein said elongated pair of surfaces carry electrical potential varying from a state of shunt having no potential to an increased state of potential at said power supply connections.

12. A method for intermittently connecting a pair of contacts to a power supply for carrying high current thereacross without arcing during the formation or interruption of a circuit including the steps of:

(a) supplying a current in the radio frequency range in a pair of parallel spaced semi-circular shaped contact strips which are shunt connected at both the engaging and disengaging ends of said strips, (b) rotating a circular shaped work support member containing a plurality of biased contacts connected in circuit to loads past said contact strips such that said contacts are periodically engaging and disengaging said contact strips, (c) causing said contacts to make a substantially arcless engagement with said contact strip at said engaging shunt connection where the voltage carried at radio frequency is essentially zero before power is transmitted to said contacts, (d) increasing the radio frequency voltage in said load circuit by moving the said contacts parallel to said contact strip such that the radio frequency voltage supplied to said load circuit increases to a maximum at the midpoint of said semicircular shaped contact strips, and (e) decreasing the radio frequency voltage in said load circuit by moving said contacts away from the midpoint of said parallel contact strips such that the radio frequency voltage decreases to essentially zero at said disengaging shunt connection of said contact strip before disengagement of said contacts from said strips.

13. An electrical circuit apparatus for intermittently connecting a power supply to a pair of movable contacts for transmitting high current low open circuit voltage radio frequency energy without arcing when the movable contacts are connected or disconnected from the power supply comprising:

(a) a radio frequency generator which has an output in the range of 200 to 1000 volts, at a frequency range of 300 to 600 kHz at a current of 75 to 200 amperes at a pair of output terminals;

(b) a pair of spaced apart parallel semi-circular shaped rectangular cross-section busses connected to said generator output terminals said busses having an interior chamber through which a coolant can be circulated for maintaining a predetermined surface temperature of said busses;

(c) shorting plates connecting the ends of said busses for shunting and causing the potential difference at said ends to be zero yet permitting the potential to increase from said shorting plates to said generator output connections, and (d) a rotating work table mounted for movement past said busses for carrying power contacts biased to first engage said busses at one of said shorting plates and to first disengage said busses at the other of said shorting plates.

14. An apparatus for transferring power from a fixed power supply to a movable load including a first means connected to a first supply terminal on said power supply and a second means connected to a second power supply terminal of said power supply;

said first and second means each extending from their respective connections from a central point to a pair of respective distal points and having shunt connections located at and across said distal points for forming a loop circuit wherein power supplied from said terminals to said first and second means respectively has the greatest potential difference between said means at said respective points of supply and has the smallest potential difference at said shunted distal points;

a pair of contacts associated with said first and second means and mounted for relative movement along said means from one shunted distal point and to said other shunted distal point and for transmitting power to said contacts, and a load connected in series across said contacts for using said power as same is transmitted from said means to said contacts.

15. The apparatus of claim 14 wherein said power supply is a radio frequency generator having a relatively low open circuit voltage, a high current and a frequency of several hundred kHz.

16. The power supply of claim 15 wherein the frequency is about 450 kHz.

17. The apparatus of claim 14 wherein said means are hollow members fashioned from metal having high conduction and low resistance at least at the surface and designed to transport a cooling fluid therethrough to stabilize the temperature at which the said means operate.

18. The apparatus of claim 17 wherein said metal is copper and said hollow member has a generally rectangular cross-section.

19. The apparatus of claim 14 wherein said load is a coil designed to carry radio frequency energy and form a field for inductively heating.

20. The apparatus of claim 17 wherein said coil has overall physical size and capability to conduct radio frequency energy which is substantially less than the size and capability of said shorting plates.

* * * * *